US005816128A

United States Patent [19]

Bigley, Jr. et al.

[11] Patent Number: 5,816,128

[45] Date of Patent: Oct. 6, 1998

[54] SEVERING DEVICE

[75] Inventors: Andrew Bruce Walter Bigley, Jr., Levittown; Edward G. Ludwig, Jr., Yardley; Ramon Calisto Perez, Bristol; Niels Haun, North Wales, all of Pa.

[73] Assignee: Rohm and Haas Company, Philadelphia, Pa.

[21] Appl. No.: 701,515

[22] Filed: Aug. 22, 1996

Related U.S. Application Data

[60] Provisional application No. 60/003,354 Sep. 7, 1995.

[51] Int. Cl.[6] ..... B26D 7/02

[52] U.S. Cl. ..... 83/452; 83/451; 83/454; 83/607; 269/288

[58] Field of Search ..... 83/54, 451, 452, 83/454, 466.1, 607, 608, 609, 947; 269/287, 288, 87.2, 43

[56] References Cited

U.S. PATENT DOCUMENTS

| | | | |
|---|---|---|---|
| 1,270,175 | 6/1918 | Lambe | 83/609 X |
| 1,632,004 | 6/1927 | Hampton . | |
| 1,717,925 | 6/1929 | Horix . | |
| 1,830,284 | 11/1931 | Massa | 83/608 |
| 2,085,321 | 6/1937 | Lang | 269/87.2 |
| 2,486,900 | 11/1949 | Willis . | |
| 3,057,240 | 10/1962 | De Witt | 83/581 |
| 3,129,000 | 4/1964 | Casson | 269/87.2 X |
| 3,143,909 | 8/1964 | Ehlert | 83/609 X |
| 3,234,838 | 2/1966 | Faull | 83/454 |
| 3,284,895 | 11/1966 | Selander et al. . | |
| 3,839,791 | 10/1974 | Framster, III . | |
| 4,428,118 | 1/1984 | Lagher . | |
| 4,567,802 | 2/1986 | Witherspoon | 83/607 X |
| 4,811,936 | 3/1989 | Laymaster | 269/43 |
| 4,973,823 | 11/1990 | Benway et al. | 269/287 X |
| 5,079,838 | 1/1992 | Stalling, Jr. . | |

FOREIGN PATENT DOCUMENTS

| | | |
|---|---|---|
| 587267 | 5/1993 | European Pat. Off. . |
| 2222548 | 5/1972 | Germany . |
| 672 282 | 11/1989 | Switzerland . |

OTHER PUBLICATIONS

Patent Abstract of Japan, vol. 18, No. 366 (M–1636), Jul. 11, 1994 & JP–A–06 099393 (Sekisui Chem. Co. Ltd.), Apr. 12, 1994.

*Primary Examiner*—Eugenia Jones
*Attorney, Agent, or Firm*—Roger K. Graham; Sudhir G. Deshmukh

[57] ABSTRACT

A device for severing flexible polymeric tube, pipe, or tubular extrudate, such as flexible light pipe, reproducibly, cleanly, and safely is described. The device comprises a block with two specially aligned cylindrical devices for holding the pipe and a slot between the devices for guiding the severing blade with minimum deviation from its path, and a pivot and mounting upon which a blade in a holder is mounted to give even more accurate and uniform control of the path of the severing action.

6 Claims, 4 Drawing Sheets

SEVERING DEVICE

This is a nonprovisional application of prior pending provisional application Ser. No. 60/003,354, filed Sep. 7, 1995.

BACKGROUND OF THE INVENTION

1. Field of the Invention

The present invention relates to a device for severing a flexible polymeric tube, pipe, or tubular extrudate, especially an organic polymer flexible light pipe, in an uniform and clean manner, allowing for less light loss at the severed interface and for efficacious rejoining of severed segments during further processing or fabrication.

2. Description of the Prior Art

Light pipes have applications in industrial, commercial and residential lighting where it is desirable to direct light from a single source to one or more remote locations. In a light pipe system, the light is transmitted from the source to the desired location by means of one or more light pipes. Light pipes may also be referred to as optical guides or optical fibers, and vary in length and diameter depending upon particular applications. For example, light pipes made from polymeric materials may have a diameter as small as 0.001 inch (25.4 microns). The largest commercially available solid core light pipes have a diameter of about 1 inch (2.54 cm). While larger diameters of light pipes may be used, a 1 inch diameter (or less) is sufficient for most applications and light from a typical commercial light source may be readily focused onto a 1 inch light pipe. Solid core light pipes, herein abbreviated "FLP" for Flexible Light Pipe, commonly have one or more layers of light-reflective or coating materials, the light-reflective layer, often a fluoropolymer, being known as "cladding" and the protective outer coating being known as "sheathing", made of a flexible and chemically resistant material.

For making a light pipe system as versatile as possible, the FLP will often be used in multiple segments, requiring connection through appropriate coupling devices adjacent to the light source at locations where the light may be led into various branch light pipes, and finally again coupled to a lens or other device for utilizing the transmitted light for illumination.

To prepare the best couplings with the minimum loss of light whilst avoiding refractive-indexed matched liquids or adhesive in the couplings, it is necessary that the FLP have clean-cut surfaces (i.e., a flat surface with no tear marks or irregularities), usually perpendicular to the pipe (which is normally in cylindrical form—if ovoid or irregular, the cut would be perpendicular to the center line of the extended FLP.) Without extreme care, it is difficult to sever a FLP with a soft or semi-liquid core, without tearing an irregular severed area; such tearing often occurs with devices such as razor blades, knife blades in holders, blade-type "paper cutters" and the like. There exists a molded plastic apparatus, designed for severing solid rubber cylindrical stock into O-rings, with a perpendicular slit through which a razor blade may be inserted, but it does not hold the light pipe steady enough for repetitive cuts which are clean and uniform.

Matsumoto, U.S. Pat. No. 5,012,579, describes a severing machine for synthetic resin pipes which involves an improved method for applying uniform pressure to the blade during the severing process. The device appears to entail no means for tightly holding and aligning the pipe to be severed and thus assure accuracy and reproducibility during the severing process. Further, the device requires means to drive the apparatus, which makes it awkward for repetitive use in an environment where electric power is not readily available.

Thus, there is no available device which will hold the pipe in a steady manner, hold it in a form where the cut is perpendicular, and perform a rapid, clean cut with no tearing to leave a smooth perpendicular surface. Further, there is no device which can be used to sever lengths of light pipe cleanly and with good reproducibility of length. The present invention overcomes the above stated problems.

STATEMENT OF THE INVENTION

We have developed such a device for severing a flexible polymeric tube, pipe, or tubular extrudate, preferably a flexible polymeric optical light pipe, to yield reproducibly a clean cut perpendicular to the surface of the linearly extended flexible polymeric light pipe. The severed flexible optical light pipe is suitable for optical re-coupling. The severing device comprises:

a) means for holding the linearly extended flexible polymeric light pipe to be severed so that the surface of the light pipe is perpendicular to the plane swept by the severing means, said holding means not interfering with the path of the severing means, said holding means comprising:

(1) two hollow cylinder blocks of a diameter larger than that of the linearly extended flexible polymeric light pipe to be severed, said cylinder blocks mounted so that the diameter line of one cylinder block when extended is the diameter line of the second, said opposing faces of said cylinder blocks being separated by a distance slightly larger than the thickness of the blade, preferably the difference between the thickness of the blade and the width of the distance being from about 0.001 to 0.010 inches;

(2) a collet inserted in each cylinder block, each collet having an outer diameter slightly smaller than the inner diameter of the cylinder and an inner diameter slightly larger than the linearly extended flexible polymeric light pipe to be severed, said opposing faces of said collets being separated by a distance slightly larger than the thickness of the blade, preferably the difference between the thickness of the blade and the distance being from about 0.001 to 0.010 inches;

(3) means for tightening the cylinder block to the collet, so that the collet is immobilized within the cylinder block;

(4) means for tightening the collet to the flexible polymeric light pipe, so that the linearly extended flexible polymeric light pipe is immobilized within the collet;

b) severing means comprising a blade of sufficient sharpness to sever cleanly the linearly extended flexible polymeric light pipe and a blade holder for said blade which clamps the blade securely, said blade being of a thickness slightly smaller than the distance between the opposing faces of the collets or cylinder blocks, said blade being of a size of exposed severing edge at least that of the diameter of the linearly extended flexible polymeric light pipe to be severed, said blade holder having a portion in the shape of a handle, said holder having an exposed area for the blade surface adjacent to said severing edge at least that of the diameter of the linearly extended flexible polymeric light pipe to be severed, said blade holder having means to attaching to a pivot mount so that it may be moved in a plane perpendicular to that of the pivot;

c) a mounting for said severing means comprising a pivot mount, having a pivot, and a baseplate, said baseplate being capable of being tightly fastened to a solid surface, said pivot mount being aligned parallel to the diameter of the linearly extended flexible polymeric light pipe after clamping and holding the linearly extended flexible polymeric light pipe, said pivot mount attaching to said blade holder through said attaching means, said pivot mount being located at a point in the block wherein the plane swept by the exposed blade on said severing means will engage the complete cross-sectional area of the cylinder or collet in the space between the opposing faces of said cylinder blocks or collets.

The apparatus described herein, as illustrated by the drawings, is a specific embodiment of the broader invention; it will be apparent that alterations can be made in the design to accommodate the full inventive concept of the device.

DESCRIPTION OF THE PREFERRED EMBODIMENT

Figure 1:
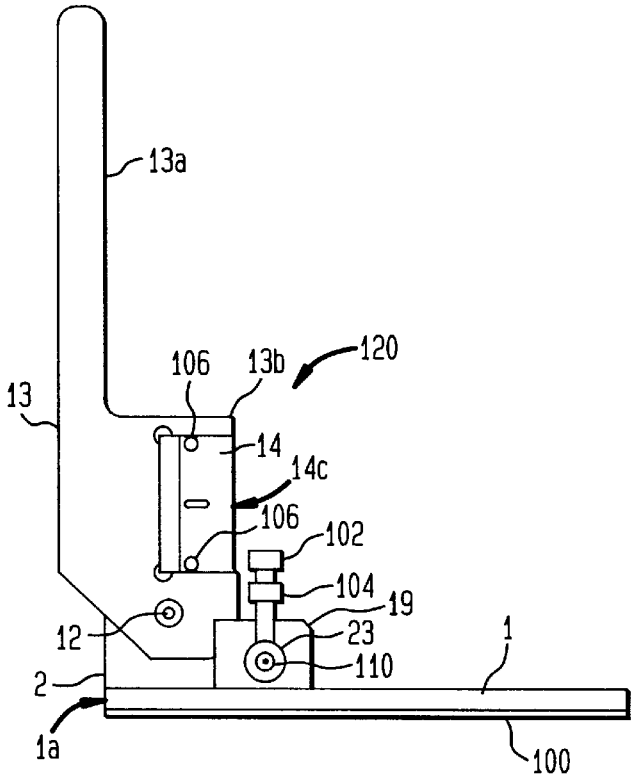
FIGS. 1 through 3 show a first embodiment, FIG. 1 being a side view, FIG. 2 being a top view, and FIG. 3 being a sectional view taken on section line II—II of FIG. 2 with a flexible polymeric light pipe (110) mounted therein.

One embodiment of the device is shown in FIGS. 1 through 15. The term "collet" is used in the dictionary sense of "a collar or enclosing band, specifically, a slotted cylindrical clamp inserted into the interior of a sleeve", so that the collet (23), having a flat end (124), is sized externally to fit within the cylinder block (19), having a flat end (124), and internally so as to allow insertion of the flexible polymeric light pipe (110) and to fit firmly around the flexible polymeric light pipe (110), further with means to tighten further upon the flexible polymeric light pipe (110) by means of external pressure. The advantage of the collet (23) over direct insertion of the flexible polymeric light pipe (110) into the cylinder block (19) and applying tightening pressure to hold the flexible polymeric light pipe (110) steady is that the collet (23) is sized close enough to the size of the flexible polymeric light pipe (110) that the flexible polymeric light pipe (110) is already held tightly without distortion of the cross-sectional area, and the pressure of one or more tightening devices to hold it very steady will not distort the flexible polymeric light pipe (110) further.

Preferred embodiments of the invention involve the use of a blade (14) which is coated with a lubricating fluoropolymer (not shown), such as polytetrafluoroethylene. Such a coating, which includes any coating or film having a low coefficient of friction, avoids the need to apply an external lubricant frequently. For ease and safety of replacement, a single-edge razor blade is preferred, and especially preferred, for ease of clamping securely, is a razor blade (14) which contains a reinforcing strip **(14*b*) across the top of the blade (14), and a severing edge (14*c*)** of the blade being at the bottom.

To hold the blade (14) immobile, it is preferred further that the blade holder (13) contains means, such as tightening bolts (106), for applying pressure perpendicular to the razor blade surface to render said blade (14) immobile relative to the blade holder (13).

For best control to tightly mount the severing blade (14), it is preferred to use a razor blade which contains notches **(14*a*) at each side of the blade (14), said notches (14*a*) being centered from about one-fourth to about three-fourths of the distance between top and bottom of the blade (14). Such notches (14*a*) are engaged in the blade holder (13) by tightening bolts (106)**.

As designed, the blade holder (13) is constrained to pass the blade (14) through a narrow passage (122) between the collets (23) which hold the linearly extended flexible polymeric light pipe (110) in a fixed manner, and the blade holder (13) is constrained to swing in an arc (not shown) which allows the severing edge **(14*c*) to descend upon and cleanly slice the linearly extended flexible polymeric light pipe (110) to be severed, but which is constrained by the design of the blade holder (13) so that the severing edge (14*c*) does not contact the base plate (1) with resultant dulling of the severing edge (14*c*)**.

Although designed to sever flexible polymeric light pipe which is a soft, flexible, sometimes semi-liquid core surrounded by a thin cladding of reflective polymer, such as a fluorocarbon polymer, and further usually surrounded by a protective sheath of a relatively tough plastic, such as polyethylene, the device may also be used to sever other objects, such as elastomers, rubber tubing, plastic tubing, and the like, which are difficult to cut without tearing or spoiling the surface exposed by the severing. The device further alleviates the need to chill the object prior to cutting or severing.

If it is desired to make a clean cut at an angle other than perpendicular to the alignment within the cylinder blocks (19) of the flexible polymeric light pipe (110) to be cut, the device may be further transmogrified so that the narrow passage (122) is angled in such a way that the plane of the cut (not shown) produces an angled cut (still perpendicular to the surface) or an angled cut which is no longer perpendicular to the surface of the flexible polymeric light pipe (110). The former will involve mounting the cylinder blocks (19) so that the narrow passage (122) between the two cylinder blocks (19) or the two collets (23) (to be filled by the linearly extended flexible polymer light pipe (110) to be cut) is not perpendicular to the plane (not shown) traversed by the blade (14), which in turn will involve modifying the angles of the flat ends (124) of the cylinder blocks (19) and collets (23) to allow clean passage of the blade (14) without excessive widening of the narrow passage (122) between the two flat ends (124).

The latter will require altering the nature of the pivot mount (2) and/or the mounting of the cylinder blocks (19) and also probably the location and angle of the pivots (not shown); for most purposes, it will suffice to mount the two cylinder blocks (19) on the base plate (1) in such a way that the narrow passage (122) between the two cylinder blocks (19) or the two collets (23)(to be filled by the linearly extended flexible polymeric light pipe (110) to be cut) is aligned such that the desired angle cut (not shown) is formed upon passage of the blade (14). The geometry of the ends of the cylinder blocks (19) and collets (23) adjacent to the severing area will require modification (not shown) to allow passage of the blade (14); also, the cylinder blocks (19) may be bored at an angle which is not perpendicular to the plane (not shown) of the blade (14). Appropriate design adjustments to the device described below may readily be calculated. Elements of the mounting used in compound miter saws (not shown) may be employed in such a design, as may the use of a swivel on the base plate (1) to move the cylinder blocks (19) to an appropriate angle (not shown), and then controlling the width of the narrow passage (122) by collet design.

It is also possible to design the collet (23) in such a way that it is also useful as part of the assembled flexible polymeric light pipe (110). For example, the collet (23) at one end (not shown) would insert into the cylinder blocks (19) for controlling the cutting of the flexible polymeric light pipe (110), while the other end (not shown) would be designed to fit into an appropriate holder to place and hold the flexible polymeric light pipe (110) in a desired position relative to an illuminator (source of light, not shown) or the area to be illuminated (not shown).

Figure 3:
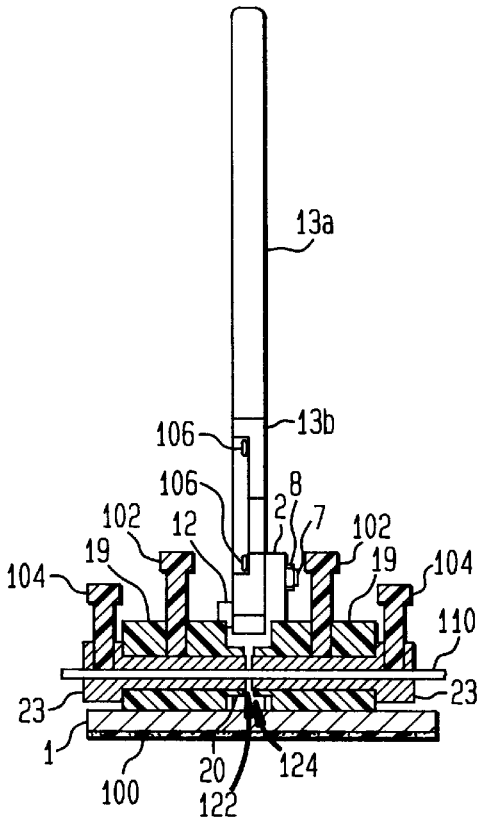
Figure 2:
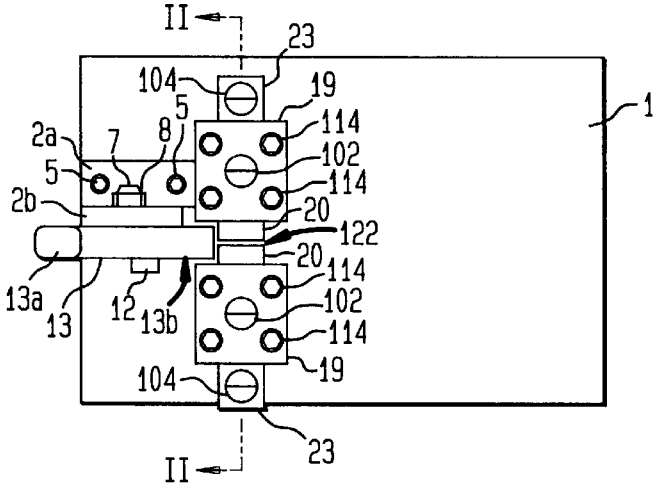
Figure 4:
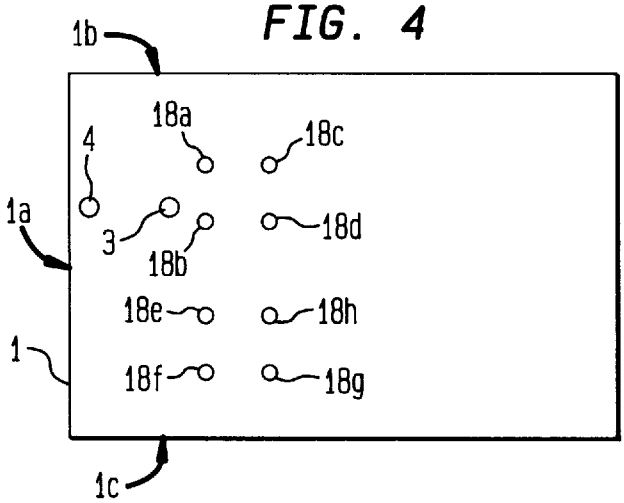
FIG. 4 is a top view of a base plate (1)

FIGS. 1 and 2 show the severing device (120) of the present invention, which is the blade holder (13) and blade (14) mounted together and installed on a mounting (not shown separately) for the blade (14) and blade holder (13), the mounting (not shown separately) comprising the pivot mount (2) and the baseplate (1); FIG. 3 further shows the means for holding the flexible polymeric light pipe (110) to be severed mounted on the baseplate (1), the means for holding comprising two hollow cylinder blocks (19), two collets (23) for the cylinder blocks (19), tightening means such as polyacetal screws (102) for tightening the cylinder blocks (19) to the collets (23), and tightening means such as polyacetal screws (104) for tightening the collets (23) to the flexible polymeric light pipe (110). Each portion will be described in detail.

The base plate (1), is machined from 6061 aluminum of dimensions 4 inches by 6 inches by 0.25 inches. A rubber pad (100) may be affixed to the bottom, or clamps (not shown) may be applied at the corners for better fastening to a fixed surface (not shown). The pivot mount (2) is mounted to the base plate (1) near edge (1*a*) through two 10/32 screw holes (3*a*) and (4*a*) (see FIG. 6) and associated holes (3) and (4) for cap screws (5) drilled in the base plate (1) 0.25 inch and 1 inch from the end and 1.489 inch from one side. The pivot mount (2) is an "L" shaped piece of ¼ inch aluminum, having a bottom (2*a*) 1.25 inches deep×0.75 inches wide, into which is drilled two 10/32 screw holes (3*a*) and (4*a*) to fasten base plate (1) and pivot mount (2) together. The pivot mount (2) has an upright portion (2*b*) and stands 1.5 inches high. The two pieces are fastened together by cap screws (5) though holes (3) and (4); see FIGS. 6 through 8 which illustrate the configurations of the pivot mount (2)for the blade holder (13).

Into the surface of the longer and upright portion (2*b*) of the L-shaped pivot mount (2) is drilled and tapped a 10/32 inch hole (6*a*) into which will be inserted a nylon ball plunger (7) which then will be held in place by a lock nut (8). The nylon ball plunger (7) will protrude just far enough to lock into place with one of three depressions (17) milled into the blade holder (13), so as to lock it in position, as will be described below. Hole (6*a*) is drilled 0.75 inches from the bottom (2*a*) of the pivot mount (2) and 0.50 inches from the edge (2*c*) of the pivot mount (2) at the edge of the base plate (1*a*); see FIG. 8.

For safety purposes, so as to block the blade holder handle (13*a*) from being raised too high and so exposing the blade (14), a cap screw hole (9) is bored in the upper corner nearest the base plate edge (1*a*) of the pivot mount (2). When a cap screw (not shown) is inserted into this cap screw hole (9), the blade holder (13) cannot be lifted above a 45° angle, and the blade (14) is less exposed. The cap screw (not shown) can be removed to pivot the blade holder (13) fully for removal of the blade (14) or cleaning of the blade (14) and blade holder (13).

A 0.25 inch pivot hole (10) with screw tapping (not shown)is drilled into the surface of the longer and upright portion (2*b*) of the L-shaped pivot mount (2) at a point 0.75 inches from the bottom (2*a*) of the pivot mount (2) and 0.875 inches from the edge (2*c*) of the pivot mount (2) mounted at the edge (1*a*) of the base plate (1). Through this pivot hole (10) and an aligned hole (112) in the blade holder (13) (see FIG. 9) will be placed a shoulder screw (12) on the side of the blade attachment part of the blade holder (13*b*) which can be tightened to hold the blade holder (13) firmly on the pivot mount (2), yet allow motion of the blade holder (13) in a severing plane (not shown). The shoulder screw (12) has a screw thread (not shown) at the end, a larger shank (not shown)which is just slightly longer than the width of the blade holder (13), and a shoulder (not shown) with an inset head (not shown); when the shoulder screw (12) is inserted, pivoting is constrained by the ending of the screw thread portion and the larger width of the shoulder portion to keep the blade holder (13) pivoting in a narrow plane.

Figure 9:
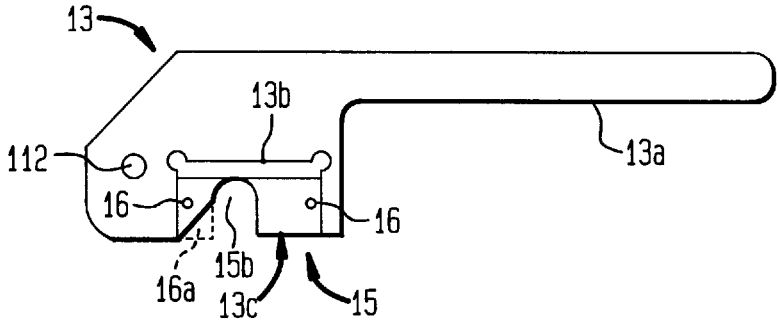
FIGS. 9 through 11 are, respectively, a side view, a bottom view, and a side view of a blade holder (13)
Figure 10:
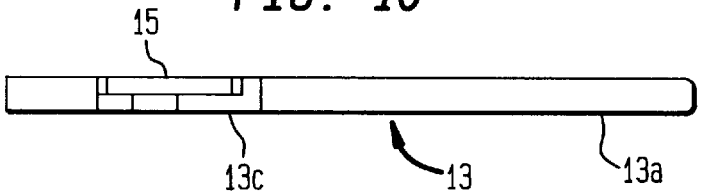
Figure 11:
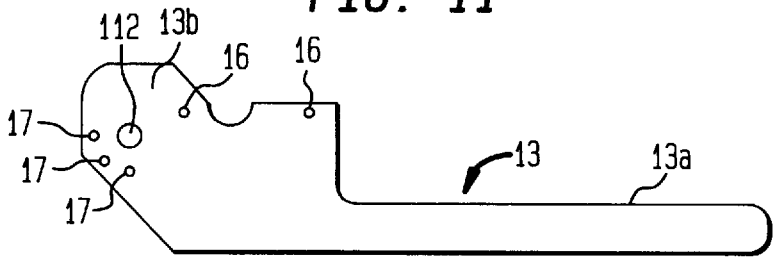

The blade holder (13)—see FIGS. 9 through 11, which illustrates the blade holder (13)—is machined from 6061 aluminum. It is 7.5 inches long, and 0.38 inches thick. The arm of the holder (13*a*) which is used for severing and which extends from the edge of the razor blade (14) to the end is 5 inches long and 0.56 inches high. The blade attachment part of the blade holder (13*b*) is 2.0 inches high and 2.75 inches wide. A triangular portion (16*a*) cut 1 inch from the edge is removed; the lower left corner is rounded with a 0.5 inch radius (not shown). The blade (14), such as a razor blade, fits into the bottom edge where a blade recess (15) 0.10 inches deep has been cut into the blade attachment part of the blade holder (13*b*) on the side (13*c*) which will be mounted away from the nearest edge. This blade recess (15) is 1.58 inches long and 0.8 inches high. Behind the blade recess (15) are drilled two 4/40 taps (16) for fastening bolts (106) which tighten on the blade (14) at the blade notches (14*c*) to hold it firmly in place. The cut-out (15*b*) for the blade recess (15) is cut through the depth of the blade attachment part of the blade holder (13*b*). The cut-out (15*b*) is shaped so as to be as large as the largest piece of light pipe to be cut, so that only the severing edge (14*c*) sweeps through the narrow passage (122) allocated for the severing operation. The cut-out (15*b*) is also shaped slightly off center, so when the severing edge (14*c*) is worn down, the blade (14) can be reversed in the blade holder (13*b*) and re-used.

Figure 5:
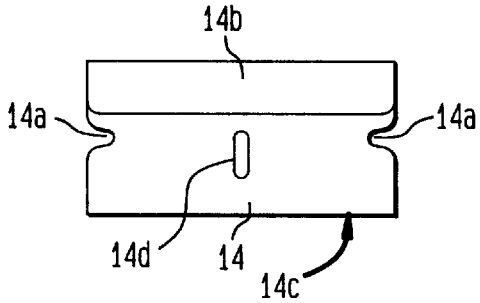
FIG. 5 is a blade (14)
Figure 6:
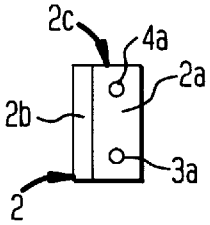
FIGS. 6 through 8 are, respectively, a top view, a side view, and a front view of a pivot mount (2)
Figure 7:
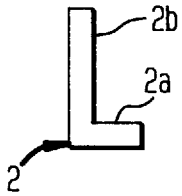
Figure 8:
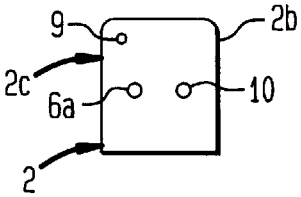

The blade (14) is a commercially available single-edge razor blade, coated with polytetrafluoroethylene—see FIG. 5. The blade (14) is 1.5 inches in length, and 0.75 inches high. Its thickness is 0.009 inches. Notches (14*a*) have been cut by the blade manufacturer in both sides 0.625 inches from the bottom or severing edge of the blade. A reinforcing strip (14*b*), added by the blade manufacturer, is attached to the blade (14), of height about 0.238 inches and of thickness about 0.015 inches. A hole (14*d*) is in the center of the blade (14). As noted above, the blade recess (15) width and height are so constructed that the blade (14) can be easily inserted and removed, but can be tightened firmly in place by the bolts (106), which fit though the notches at 14*a*.

For safety and to hold the blade holder (13) in various positions, there are machined into the blade attachment part of the blade holder (13*b*) three depressions (17) which are at angles of 0°, 45°, and 90° to the position of the blade holder (13) when the blade holder handle (13*a*) is parallel to the base plate (1). These depressions (17) are machined at a distance equivalent to the distance between holes 6 and 10. The nylon ball plunger (7) will then engage one of the depressions (17) so as to hold the blade (14) at one of three angles (not shown), but allow it easily to be released for severing purposes.

When fastened into the blade recess (15), and when the blade holder handle (13*a*) is parallel to the base plate (1), i.e., when the blade (14) has been lowered to pass through the narrow passage (122), the severing edge (14*c*) of the razor blade (14) will not touch the base plate (1), as the blade recess (15) is so machined that the severing edge (14*c*) of the blade (14) is slightly above the bottom edge (13*c*) of the blade holder (13).

Into the base plate (1) are drilled eight holes (18*a* through 18*h*) to hold the cylinder blocks (19) for the flexible polymeric light pipe (110) to be cut. The first set (18*a* to 18*d*) at edge (1*a*) of the base plate (1) where the pivot mount (2) is mounted comprise a rectangle 0.875 inches along the longer edge of the base plate by 0.65 inches along the narrower edge of the base plate (1). The holes (18*a* and 18*b*) closest to the pivot mount (2) are 1.375 inches from the narrower edge (1*a*) of the base plate (1) and 1.00 inch (18*a*) and 1.65 inches (18*b*), respectively, from the longer edge (1*b*) of the base plate (1). The second set (18*e*–18*h*) at the opposite side of the base plate (1) where the pivot mount (2) is mounted comprise a rectangle 0.875 inches along the longer edge (1*c*) of the base plate (1) by 0.65 inches along the narrower edge (1*a*) of the base plate (1). The holes (18*e* and 18*f*) closest to the pivot mount (2) are 1.375 inches from the narrower edge (1*a*) of the base plate (1) and 1.312 inches (18*e*) and 0.662 inches (18*f*), respectively, from the longer edge (1*c*) of the base plate (1).

Figure 12:
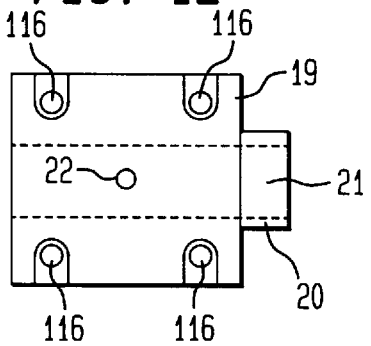
FIGS. 12 through 14 are, respectively, a top view, a front view, and a side view of a cylinder block (19)
Figure 13:
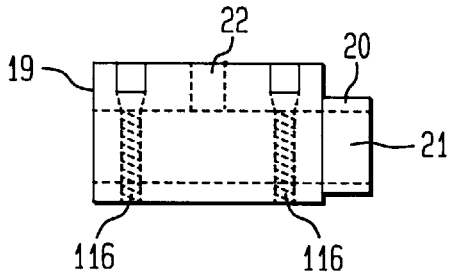
Figure 14:
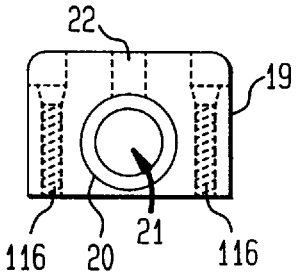

The cylinder blocks (19) are attached to the base plate (1) by screws (114) which are tightened into the baseplate holes (18*a* through 18*h*) through vertical holes (116) drilled vertically at the same dimensions as the patterns of holes (18*a* through 18*h*). Screws (114) of sufficient length to allow manual tightening and loosening pass through the vertical holes (116) to the tapped holes (18*a* through 18*h*) . The cylinder blocks (19) are illustrated in FIGS. 12 through 14.

The cylinder blocks (19) are made from polyacetal resin and are 0.75 inches high by 1.68 inches wide by 1.12 inches deep, except that at the edge which faces the severing area, there is an cylindrical extension (20) which is 0.28 inches long and 0.52 inches in diameter, the cylindrical extension (20) being centered over the center of a drilled cylindrical hole (21). (If desired, the portion of the cylinder block (19) not pierced with the cylindrical hole (21) may be machined off (not shown) to leave only a base portion (not shown) for fastening via set screws in holes (18*a* through 18*h*). The cylindrical hole (21) is bored with its center 0.56 inches from the sides and 0.291 inches from the bottom face (which sits on the base plate (1)). This cylindrical hole (21) is of diameter 0.384 inches. The portion of the cylinder block (19) within the cylindrical extension (20) is slightly flared as a chamfer of 0.03 inches by a 45° angle (not shown).

In the top of a cylinder block (19) is drilled a vertical tapped hole (22) which is located 0.84 inches from the face edge of the cylindrical extension (20) (0.56 inches from the rear face). Into this 10/32 vertical tapped hole (22) is inserted a polyacetal screw (102) which may be turned by hand to exert pressure on the collet (23) inserted in the cylindrical hole (21) and keep the collet (23) from moving. Multiple holes and screws could be utilized for this purpose, or some method which would exhibit uniform pressure on the collet (23) could be employed (not shown).

As the cylindrical hole (21) is of fixed size (9.75 mm.) whereas the flexible polymeric light pipe (110) to be cut will be of several sizes (e.g., 3, 5, 7, or 9 mm.), various collets (not shown) are employed. These collets narrow the diameter of the cylindrical hole (21) which holds the flexible polymeric light pipe (110) to a value just large enough to allow easy insertion and removal, and only slight additional pressure by a tightening device (not shown) to hold the flexible polymeric light pipe (110) steady in the collet (23), which in turn is held steady in the cylinder block (19) by a screw (22).

Figure 15:
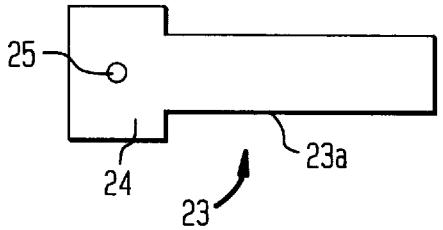
FIG. 15 is a top view of a collet (23).

A typical collet (23), as illustrated in FIG. 15, is machined from an aluminum cylinder (23*a*) with a hole (not shown) inside, the outer diameter of the aluminum cylinder (23*a*) being just smaller than the diameter of the cylindrical hole (21). At the end of the collet (23) away from the narrow passage (122) is present a shoulder (24) which is 0.5 inches long and 0.5 inches in diameter. The aluminum cylinder (23*a*) of the collet is 1.41 inches long, which is just slightly longer than the length of the cylindrical hole (21). The collet (23) may be manufactured from one piece of aluminum pipe, rather than attaching a separate sleeve (not shown). The interior diameter of the collet is 5 mm. (0.197 inches).

In the shoulder (24) is tapped a vertical hole (25) which is located 0.25 inches from the rear edge of the shoulder (24). Into this 10/32 vertical hole (25) is inserted a polyacetal screw (104) which may be turned by hand to exert pressure on the flexible polymeric light pipe (110) inserted in the collet (23) and keep the flexible polymeric light pipe (110) from moving. Multiple holes (not shown) and screws (not shown) could be utilized for this purpose, or some method which would exhibit uniform pressure on the flexible polymeric light pipe (110) could be employed.

In practice, the device is assembled and it is determined that the centers of the cylindrical holes (21) are aligned, and that the narrow passage (122) between the facing edges of the collets (23) is sufficient to allow the severing edge (14*c*) of the razor blade (14) to pass through that narrow passage (122) upon lowering the blade holder handle (13*a*). The blade holder handle (13*a*) is then raised 45°, a piece of 5 mm flexible polymeric light pipe (110) is inserted through both collets (23), the polyacetal screws (102) and (104) are tightened, and the blade holder handle (13*a*) is lowered to cause the blade (14) to sever the flexible polymeric light pipe (110). A clean cut on both surfaces is observed (not shown).

The severing edge (14*c*) ay be the conventional shape as found in a commercial razor blade, where the two severing surfaces taper inwards at equal angles (not shown). These tapering edges may be slightly beveled. However, although well adapted for shaving, these blades do not give the best perpendicular cut for the cleanest surfaces, although the cuts are adequate for most purposes.

An improvement is to shape the blade so that one side of the blade is extended in a straight line in the plane of the cutting stroke, and the other edge is tapered to the desired cutting edge thickness (not shown). When mounted in the blade holder (13), the straight edge will face the portion of the flexible polymeric light pipe (110) which requires the best surface (not shown). For example, if the severing device is used to trim the end of a piece of flexible polymeric light pipe (110) prior to re-connection, then the flat edge of the blade not shown) will contact the new end cut on the flexible polymeric light pipe (110), while the tapered edge (not shown) faces the small end piece (not shown) which is removed and discarded.

Various other attachments may be made, such as means for measuring a specific length of light pipe to be cut. The device may be used to sever flexible light pipe which does not have an external protective sheathing. The device may be used to sever a bundled flexible light pipe, i.e., where several light pipes are bundled together within a single protective sheath.

What is claimed is:

1. A device for severing a flexible polymeric light pipe comprising:

(a) means for holding said light pipe comprising:

(i) two cylinder blocks mounted on a base plate, each of said cylinder blocks having an axially aligned hole to allow insertion of said light pipe therethrough, said cylinder blocks being separated from each other to produce a narrow passage therebetween, (ii) a collet received in each of said cylinder blocks, each of said collets having a hole sassing through an elongated cylindrical portion and a shoulder portion of said collet, said shoulder portion being larger in diameter than said cylindrical portion, said cylindrical portion being inserted in each of said axially aligned holes of said cylinder blocks, (iii) means for immobilizing said pipe, said immobilizing means being received in each of said shoulder portions for tightening each said shoulder portion to the linearly extended flexible polymeric light pipe sufficiently away from said narrow passage to prevent distortion of an exposed portion of said pipe at said narrow passage when said pipe is passed through said hole of each said collets; and (b) means for severing said flexible polymeric light pipe, said severing means mounted on said base plate and comprising a manually movable blade holder having a blade positioned therein, such that said blade passes through said narrow passage to sever said exposed portion of said pipe to yield a clean perpendicular cut thereon when said pipe is positioned in said device.

2. The device of claim 1 wherein the blade is coated with a lubricating fluoropolymer.

3. The device of claim 1 or claim 2 wherein the blade is a single-edge razor blade.

4. The device of claim 3 wherein the razor blade has a reinforcing strip across a top of the blade and a severing edge at a bottom of the blade.

5. The device of claim 3 wherein the severing means further contain means for applying pressure perpendicular to said razor blade surface to render said blade immobile relative to the blade holder.

6. The device of claim 3 wherein the razor blade contains notches at each side of the blade, said notches being centered from about one-fourth to about three-fourths of the distance between a top and bottom of the blade.

* * * * *